US012207698B2

(12) United States Patent
Tatibouet et al.

(10) Patent No.: US 12,207,698 B2
(45) Date of Patent: Jan. 28, 2025

(54) METHOD FOR MANUFACTURING A FOOTWEAR ARTICLE

(71) Applicant: DECATHLON, Villeneuve d'Ascq (FR)

(72) Inventors: Carly Tatibouet, Villeneuve d'Ascq (FR); Anne-Claire Magnard, Villeneuve d'Ascq (FR); Jarvis Huang, Villeneuve d'Ascq (FR); Terry Lee, Villeneuve d'Ascq (FR)

( * ) Notice: Subject to any disclaimer, the term of this patent is extended or adjusted under 35 U.S.C. 154(b) by 125 days.

(21) Appl. No.: 17/627,144

(22) PCT Filed: Jul. 16, 2020

(86) PCT No.: PCT/EP2020/070233

§ 371 (c)(1),
(2) Date: Jan. 14, 2022

(87) PCT Pub. No.: WO2021/009328

PCT Pub. Date: Jan. 21, 2021

(65) Prior Publication Data

US 2022/0354218 A1 Nov. 10, 2022

(30) Foreign Application Priority Data

Jul. 17, 2019 (FR) ..... 1908054

(51) Int. Cl.

| | |
|---|---|
| ***A43B 1/04*** | (2022.01) |
| ***A43B 1/028*** | (2022.01) |
| ***A43B 23/02*** | (2006.01) |

(52) U.S. Cl.
CPC ..... *A43B 1/04* (2013.01); *A43B 1/028* (2022.01); *A43B 23/0255* (2013.01)

(58) Field of Classification Search
CPC ..... A43B 23/0255; A43B 1/04
See application file for complete search history.

(56) References Cited

U.S. PATENT DOCUMENTS

| | | | |
|---|---|---|---|
| 2014/0082905 A1 | 3/2014 | Wen | |
| 2015/0230544 A1 | 8/2015 | Bacino | |
| 2017/0181501 A1 | 6/2017 | Gautier et al. | |
| 2019/0098961 A1* | 4/2019 | Chang | A43B 23/04 |

(Continued)

FOREIGN PATENT DOCUMENTS

| | | |
|---|---|---|
| CN | 106535688 A | 3/2017 |
| EP | 3501316 A1 | 6/2019 |

*Primary Examiner* — Ted Kavanaugh
(74) *Attorney, Agent, or Firm* — Brian Gordaychik

(57) ABSTRACT

The subject of this disclosure is a method for manufacturing a footwear article comprising providing of a first knitted tubular part comprising at least one fusible portion, at least one sole part, at least one flattening opening of unitary knitted construction with the first knitted tubular part and extending at least in the sole part, and providing one or more functional components, disposing, at least partly, the first tubular part substantially flat using the flattening opening; functionalizing the first knitted tubular part, at least partly, substantially flat with one or more functional components to form a footwear assembly; and transforming the footwear assembly on a preform having the foot shape in an upper, transforming the footwear assembly comprising thermo-forming the footwear assembly to follow the foot shape of the preform.

17 Claims, 4 Drawing Sheets

(56) References Cited

U.S. PATENT DOCUMENTS

| | | | | |
|---|---|---|---|---|
| 2019/0116932 | A1* | 4/2019 | Bell | A43B 23/025 |
| 2019/0208862 | A1* | 7/2019 | Poegl | D04B 9/22 |
| 2019/0231021 | A1* | 8/2019 | Hoying | A43B 23/042 |
| 2020/0029647 | A1* | 1/2020 | Unnewehr | A43B 23/0255 |

* cited by examiner

[Fig. 1]
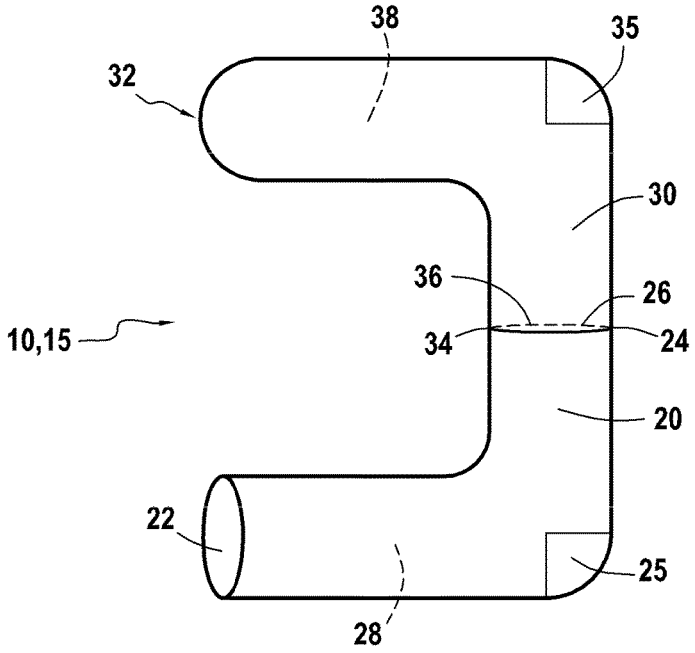
[Fig. 2]
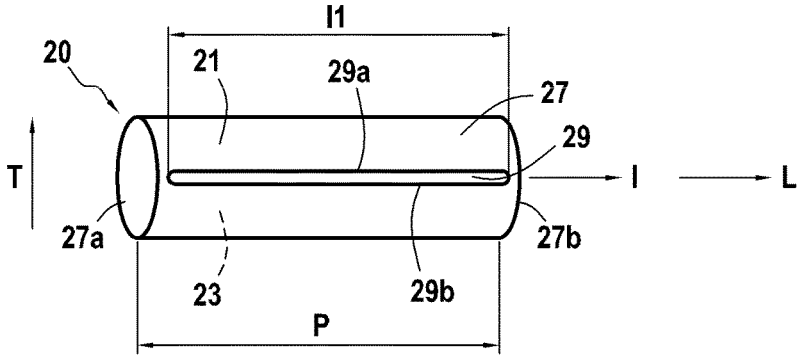
[Fig. 3]
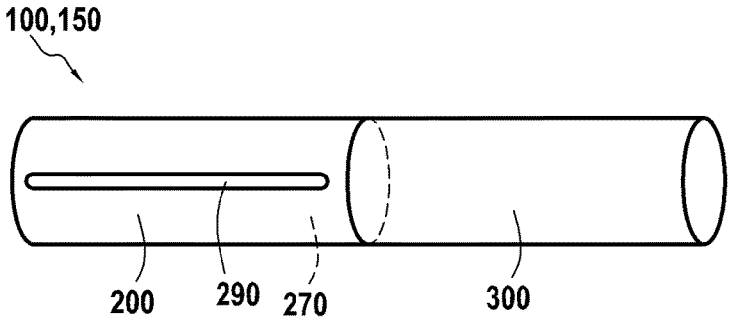

[Fig. 4]
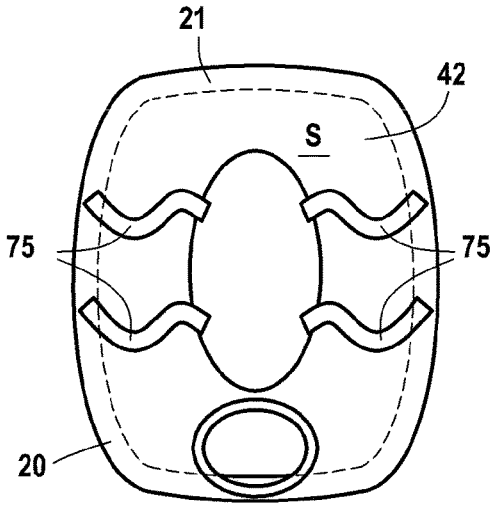
[Fig. 5]
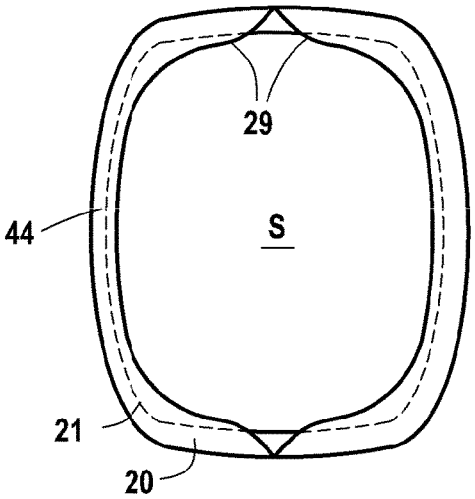
[Fig. 6]
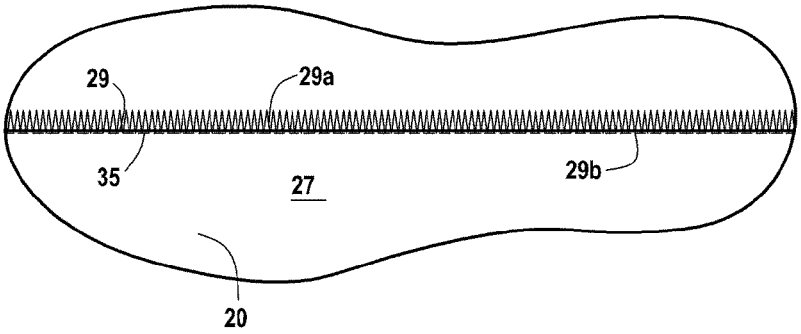

[Fig. 7]
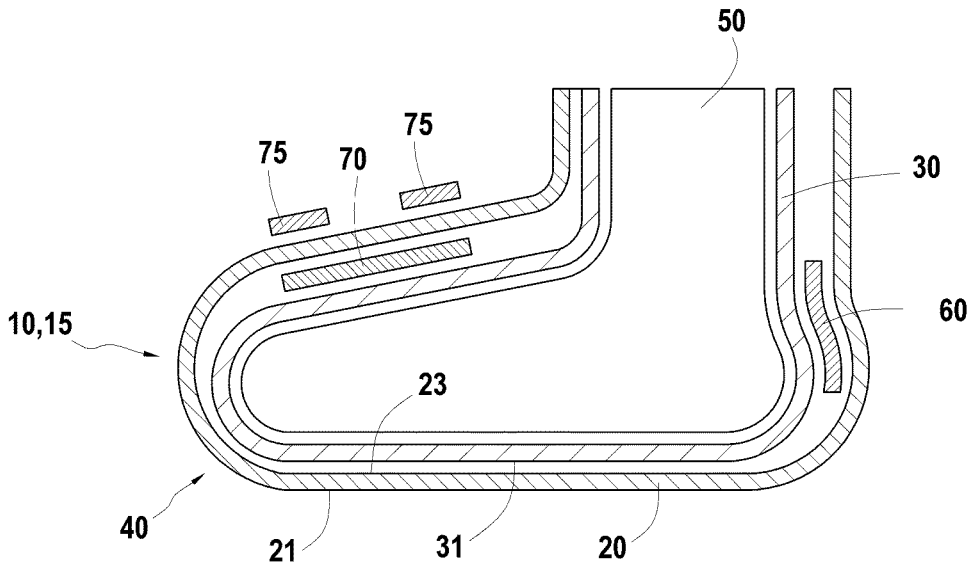
[Fig. 8]
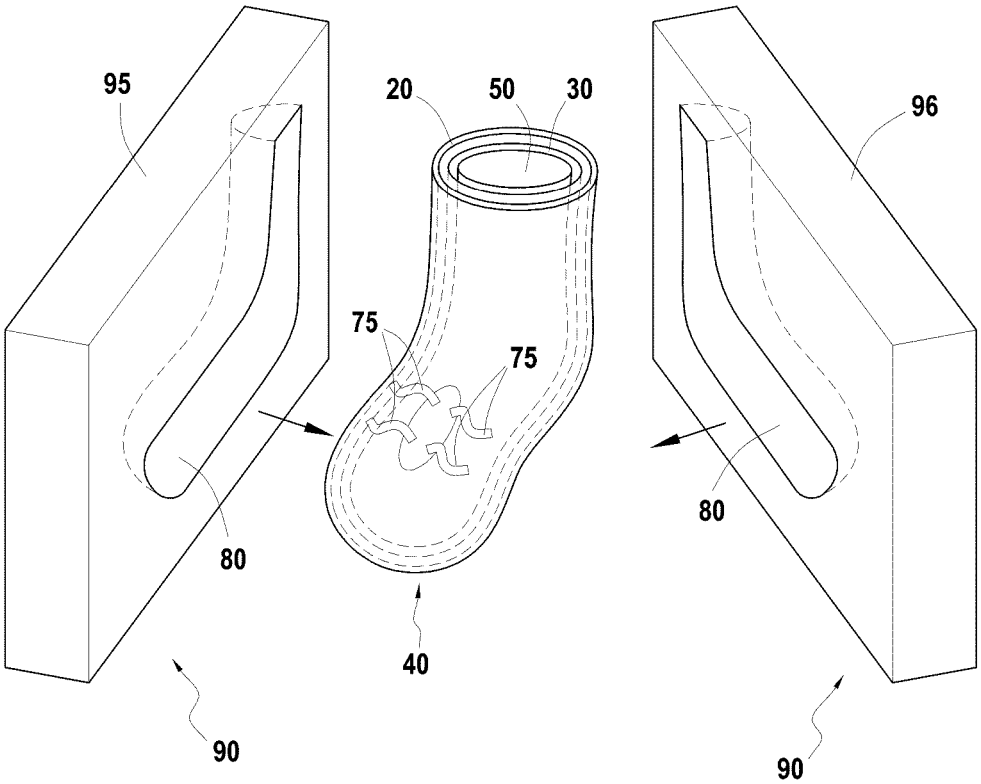

[Fig. 9]
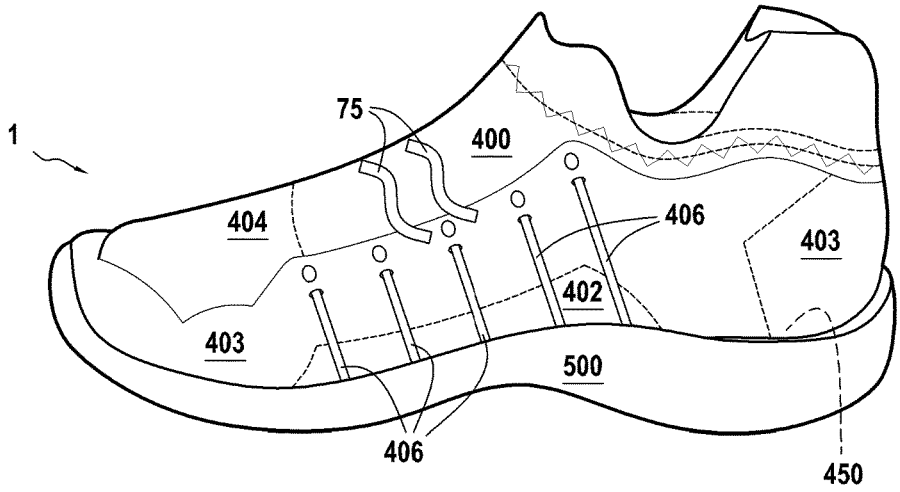

METHOD FOR MANUFACTURING A FOOTWEAR ARTICLE

TECHNICAL FIELD

The subject of this disclosure is a method for manufacturing footwear article, in particular for the practice of sports.

The subject of this disclosure is a method for manufacturing a footwear article, in particular the upper of said footwear article, implementing one or more tubular knitted component(s) in three dimensions for the production of an upper comprising an integrated sole part.

BACKGROUND

Footwear articles generally include two main elements, namely an upper and a sole structure. The upper is secured to the sole structure and forms an empty space or volume for housing the foot inside the footwear article to receive the foot securely and comfortably. The sole structure is secured to the lower area of the upper and is thus positioned between the upper and the ground.

In footwear articles, for example for practicing sports, the sole structure may include a midsole and an outsole, the outer face of which is intended to come directly into contact with the ground.

The midsole generally comprises a material made of polymer foam which attenuates impact reactions with the ground to reduce the impact return forces generated on the foot and the leg during walking, running, or other activities during the wearing of the footwear article.

Additionally, the midsole may comprise one or more chambers filled with a fluid, one or more shock-absorbing parts or other elements that makes it possible to attenuate impact return forces and improve stability or else influence the movements of the foot and therefore the grip.

The outsole is secured to the lower surface of the midsole and provides a portion for engagement of the sole structure with the ground, which ground engagement portion is formed out of a wear-resistant and durable material, such as for example rubber or a synthetic elastomer. The sole structure can also comprise an inner lining positioned inside the foot-housing volume of the upper and near the lower surface of the foot to improve the comfort of the footwear article.

The upper generally comprises many pieces, such as a lateral quarter, a medial quarter, a front protective cap, a tongue, a heel, a heel counter, a vamp, a tightening device with in particular holes/(eyelets for a lace to pass through) and a lace, an inner lining and optionally other parts. Some of these pieces may be made of several parts. The manufacturing of a shoe thus requires the assembly of these different pieces to form a three-dimensional upper by cutting out these pieces and assembling them flat.

The upper generally extends above the arch of the foot and in the areas of the toes of the foot, along the lateral and medial sides of the foot, and around the ankle area of the foot.

In certain applications such as basketball, for example, or else hiking, the upper can extend upward and around the ankle to provide support and additional protection to the ankle. The tightening device is often incorporated into the upper to adjust the size of the upper and thus allow the entry and withdrawal of the foot into and out of the empty space formed inside the upper. The upper may also comprise a tongue extending beneath the tightening device, for example the lacing system, to adjust the footwear article, and the upper may comprise a back reinforcement element to limit heel movements. The assembly of these various components/elements/pieces requires a good deal of time and can lead to errors in the manufacturing of the footwear article. The potential number of errors can thus be significant and complicate the manufacturing process and therefore also make it more expensive.

The upper once shaped, and therefore given volume, particularly by assembly at the level of the heel, for example using a seam, is associated in a known manner with a sole element, in particular entering into a sole structure, to delimit a footwear volume.

The upper can thus be bonded to the sole element by a layer of adhesive; it can be bonded to an insole which is relatively stiff.

Alternatively, the upper can be assembled on the sole element by shaping the upper using different seams then by assembling the upper on the insole by sewing according to the so-called Strobel technique. The insole is in this case generally soft in order to be able to be sewn. The insole thus forms the sole part or bottom of the upper.

The time and costs associated with the shipping, storage, cutting-out and assembling of the different components are very significant. In addition, when cutting out and assembling components, a good deal of waste is generated. Footwear articles with a large number of components made of different materials are harder to recycle since it is, in particular, complicated to separate the components for their recycling. Thus, by reducing the number of different components entering into the composition of a shoe it is possible to reduce the quantity of waste and improve the efficiency of the method for manufacturing such footwear articles and the recyclable nature of the uppers.

Provision has thus been made for producing footwear articles implementing an upper obtained from the manufacturing of a tube knitted in three dimensions. These methods first implement the knitting of the insole upper by knitting a tubular knitted component of substantially sock-like shape.

The method then may include producing a longitudinal cut-out in the sole part of the knitted tubular component, then disposing this knitted tubular component flat using the longitudinal cut-out such as to make a planar portion appear, on which one or more functional components can be disposed flat. These functional components such as a logo, reinforcement elements, lacing eyelets, a hard cap or else a vamp or else a heel reinforcement, are applied manually to the planar portion of the knitted tubular part then secured to one another, for example by bonding and/or sewing. The longitudinal cut made in the sole part manually is then closed, for example using a seam. One then obtains a footwear assembly comprising the insole upper secured to one or more functional components. This footwear assembly is placed on a preform in the foot shape, then thermoformed to the foot shape of the preform to form the final upper. Since the dimensions of the preform correspond to a given foot size, many preforms are needed. The preforms are made of plastic or composite materials. Finally, a sole element such as a midsole is secured to the sole part of the final upper.

The production of a longitudinal cut-out in the sole part of the knitted tubular part in order to dispose this latter flat and be able to produce its functionalization requires additional steps.

There is a need for a method for manufacturing a footwear article limiting the number of steps needed for the manufacturing of an upper and not damaging the functional component(s) implemented.

There is also a need for a manufacturing method making it possible to reduce manufacturing time and improve the quality of the upper obtained.

SUMMARY

The subject of this disclosure is a method for manufacturing a footwear article, limiting the number of components and/or pieces, thus making it possible to significantly reduce the manufacturing time, the number of manufacturing steps, limiting the assembly errors, minimizing the quantity of waste, and improving the quality of the upper obtained in terms of appearance and mechanical properties.

The subject of this disclosure is also a method offering more possibilities in the esthetic design of the upper, and making it possible to improve the stabilization of the upper.

This subject of this disclosure is a method for manufacturing a footwear article palliating all or part of the aforementioned problems, in that it may include the steps of:

(i)—providing a first knitted tubular part that may include at least one fusible portion, at least one sole part, at least one flattening opening of unitary knitted construction with the first knitted tubular part and extending at least in the sole part, and may provide one or more functional components;

(ii)—disposing, at least partly, the first tubular part substantially flat using the flattening opening;

(iii)—functionalizing the first knitted tubular part, at least partly, substantially flat with one or more functional components to form a footwear assembly;

(iv)—transforming the footwear assembly previously disposed on a preform having the foot shape in an upper, wherein transforming the footwear assembly may include thermoforming the footwear assembly to follow the foot shape of the preform.

Advantageously, the flattening opening is formed at the time of knitting of the first knitted tubular part. Said flattening opening is therefore knitted. The step of cutting out the flattening opening in the sole part is thus dispensed with. Moreover, since the flattening opening is formed by knitting, it is positioned and dimensioned at least over the sole part reproducibly, thus avoiding errors when it is produced manually.

In an aspect of the disclosure, the at least one flattening opening may include edges, particularly medial and lateral disposed between the front and back edges of the sole part of the first knitted tubular part, for example that at least one of the edges, particularly medial and lateral, does not comprise any cut threads.

Advantageously, the flattening opening according to the disclosure may not include any edges liable to unravel since they do not include any cut threads.

In an aspect of the disclosure, the flattening opening may include at least one longitudinal segment, extends along a longitudinal axis I, parallel or colinear with the longitudinal axis L of the footwear assembly, and particularly of the upper. In an example, the flattening opening may include a single segment or at least two segments, in particular secant, for example perpendicular or in the shape of a cross.

Each segment can be substantially rectilinear or curved, and/or extend along the longitudinal axis L or the transverse axis T or in any direction cutting the longitudinal L and transverse T axes.

The segment(s) may include a flattening opening may define the shape of the latter.

In the present disclosure the term "longitudinal" should be understood to mean the direction L extending over a length or a major axis of the footwear article or upper or footwear assembly, or first or second tubular part. In certain cases, the longitudinal direction can extend from a forefoot region toward a hindfoot region of the footwear article or of the upper or of the footwear assembly, or of the first or the second knitted tubular part.

The longitudinal axis L is secant, particularly substantially perpendicular, to the transverse axis T of the upper or of the footwear assembly, or of the first or second tubular part.

In the present text the term "lateral" should be understood to mean the direction T extending over a width of a minor axis of the footwear article or of the upper or of the footwear assembly, or of the first of the second knitted tubular part. The lateral direction may thus extend between the medial side and the lateral side of the footwear article.

In this disclosure the term "vertical" should be understood to mean the direction extending generally perpendicularly to the lateral direction and to the longitudinal direction.

Preferably, the longitudinal axis L corresponds to the longitudinal axis of symmetry of the upper or footwear assembly.

During the functionalizing step (iii), the functional component(s) can be disposed on the first knitted tubular part and/or on the second knitted tubular part by sewing and/or bonding and/or by welding, particularly heat welding, particularly ultrasonic, using one or more retaining points; in particular by one or more seams and/or one or more dots of adhesive and/or one or more weld spots, for example ultrasonic welding. This provision makes it possible to maintain the functional component or components in it or their functional locations, optionally while awaiting complete securing during the thermoforming step (iv).

During the functionalizing step (iii), the functional component or components can be secured disposed on the first knitted tubular part and/or the second knitted tubular part by sewing and/or by bonding and/or by welding, particularly heat welding, particularly ultrasonic.

By definition, thermoforming involves the application of heat to the footwear assembly, for a time period and at a temperature sufficient to obtain the thermoforming of the footwear assembly to the foot shape of the preform. In an aspect of the disclosure, the temperature(s) applied during the transforming step (iv) may be greater than or equal to the melting and/or softening temperature(s) of the fusible portion(s) of the first knitted tubular part and/or of the second knitted tubular part.

The fusible portion(s) may be distributed over the first knitted tubular part, and where applicable the second knitted tubular part (defined hereinafter), such as to allow the thermoforming.

The transformation step (iv) makes it possible, by contributing heat, to fuse/soften the fusible portion(s), the footwear assembly may be also compressed and pressed against the outer surface of the preform. After the cooling of the footwear assembly, particularly to ambient temperature, held under pressure against the outer surface of the preform, the footwear assembly then definitively retains the foot shape of the preform. The melting or softening, then cooling, of one or more fusible portions makes it possible to impart to the footwear assembly the foot shape of the preform, and where applicable to secure the functional component(s) to the first tubular part.

The thermoforming can be done by applying one or more heat source(s) to the footwear assembly placed on the preform, for example using an iron manually.

In an aspect of the disclosure, the thermoforming may be done by placing the footwear assembly in a molding volume delimited on the one hand between the outer surface of the preform, and on the other hand with the complementary imprint of the foot shape of the preform formed by a mold, particularly in at least two parts, or formed by a flexible and deformable membrane (in particular airtight). This disposition allows a better distribution of heat, and makes it possible to apply pressure to the footwear assembly by way of the mold or membrane so that it perfectly fits the outer surface of the preform.

The membrane can be made of a flexible and deformable, for example made of silicone or polyurethane. The membrane is by definition airtight.

The flattening opening (and therefore particularly the segment(s) it comprises) may be a through opening. It therefore opens at once onto the inner face (and therefore the inner volume housing the foot) and the outer face of the sole part of the first knitted tubular envelope.

In an aspect of the disclosure, the flattening opening is formed of a longitudinal segment having a length l1 greater than or equal to 50%, so preferably greater than or equal to 70%, particularly less than or equal to 90%, to the length of the sole part comprising said flattening opening. The length of the sole part is calculated as being the greatest length measured between the front and back edges of the sole part.

In an example, said flattening opening(s) may be disposed in the sole part of the first knitted tubular part (and where applicable in the sole part of the second knitted tubular part).

In an example, said at least one flattening opening may be disposed in the sole part of the first knitted tubular part and also extends in the back part, and where applicable in the back leg part (for example if it is a footwear assembly of boot type), of the first (and where applicable the second) knitted tubular part.

The functional component(s) can be secured by way of the fusible portion(s) that the first knitted tubular part and/or the second knitted tubular part (defined hereinafter) may include, and/or the fusible portion(s) that the functional component(s) itself/themselves may include, and/or one or more adhesive means, particularly at least partly fusible. In the latter case, the adhesive mean(s) may be considered as equivalent to one or more functional component(s) according to an aspect of the disclosure having an intermediate securing function.

The functional component(s) according to an aspect of the disclosure may have at least one function chosen from the following functions: shock absorber, reinforcement, adhesion, continuous or discontinuous protective coating, esthetic appearance, or a combination thereof.

The first knitted tubular part and/or the second knitted tubular part (defined hereinafter) can be knitted on a double needle straight-bar knitting machine, or on a circular knitting machine.

In an aspect of the disclosure, the first knitted tubular part and/or second knitted tubular part may be each an envelope comprising a sole part (intended to come under the foot of the wearer), a lateral part (intended to come into contact with the lateral side of the foot of the wearer), a medial part (intended to come into contact with the medial side of the foot of the wearer), a front part in the extension of the medial, lateral and sole parts (intended to cover the front of the foot), and a back part in the extension of the medial, lateral and sole parts (intended to cover the back of the foot, and therefore the heel, and where applicable the ankle). The envelope may be arranged such as to cover all or part of the ankle and where applicable extend over the malleolus.

The front part of the envelope may comprise a tongue and a distal pocket intended to receive the toes. The tongue can form a single part with the front part only along its front edge or be secured to the front part, in addition to its front edge, along its lateral and medial edges with the lateral and medial parts respectively.

The back part may include a pocket configured to receive the heel.

The envelope may delimit a volume or empty space intended to house the foot of the wearer.

In an example, the first knitted tubular part is of unitary knitted construction with the knitted envelope such that the envelope and the first knitted tubular part comprise a single knitted piece.

In an example, the second knitted tubular part is of unitary knitted construction with the knitted envelope such that the envelope and the second knitted tubular part are made of a single knitted piece. In this case, the knitted piece forming the second knitted tubular part and the knitted piece forming the first knitted tubular part are secured to one another, particularly during the transforming step (iv), for example by sewing.

In an example, the first knitted tubular part and the second knitted tubular part are each in an envelope, the two envelopes being of knitted construction forming a single part with their first and second respective knitted tubular parts such as to comprise a single knitted piece.

The first knitted tubular part and/or the second knitted tubular part may include one or more yarn(s), particularly assembled mechanically by knitting.

The yarn(s) can be independently selected from: one or more monofilament yarn(s), one or more fiber spun yarn(s), one or more multifilament yarn(s), and a combination thereof.

The yarn(s) can be non-fusible yarns, at least partially fusible or totally fusible, or a mixture thereof.

Thus, the first knitted tubular part and/or the second knitted tubular part (each) may include one or more at least partly fusible yarn(s), and/or one or more of the non-fusible yarn(s).

In the present text the term "fusible" as applied to a material, yarn, portion, first component, or equivalent, should be understood to mean that the latter is configured to be melted or at least softened enough during the transforming step (iii) in order to allow the thermoforming of the footwear assembly, and where applicable the securing of the first and second tubular part(s) to one another.

The footwear assembly may thus include one or more materials which are fusible by application of heat (and therefore in the strict sense fusible but which will not be activated during step (iv) since their melting temperature(s) is/are greater than the heating temperature(s) implemented during the step (iv). This material or these materials is/are considered in this text as being non-fusible.

Fusible yarns, particularly at least partially, can be yarns including at least two components, particularly of the dual-component type, a first component having a melting temperature less than or equal to the heating temperature(s) employed in step (iv), and a second component having a given melting or degradation temperature greater than the heating temperature(s) employed in step (iv).

Fusible yarns can be single-component yarns, the melting temperature of which is less than or equal to the heating temperature(s) employed in step (iv).

Bicomponent yarns can be of core-sheath type, the core being formed of the second component and the sheath being formed of the first component.

The first component can be chosen from the polyurethanes, particularly thermoplastic polyurethane; polyamides, such as polyamide 6 or 6-6; polyolefins, such as polypropylene (PP) or polyethylene (PE); preferably from the polyurethanes.

The second component can be chosen from the polyolefins, such as high-density polyethylene; polyamides, such as polyamide 4-6, polyamide 6 or 6-6; polyesters, such as polyethylene terephthalate.

Bicomponent yarns can be of core-sheath type, the core being formed of the second component and the sheath being formed of the first component.

The first component and/or the second component can be colored or colorless and/or opaque or transparent.

In an aspect of the disclosure, the fusible component(s) have a melting or softening temperature less than or equal to the heating temperatures.

In an aspect of the disclosure, the heating temperature(s) applied to the footwear assembly during the transforming step (iii) is/are greater than or equal to 80° C., still preferably greater than or equal to 90° C., preferably greater than or equal to 100° C.

In an aspect of the disclosure, the heating temperature(s) applied to the footwear assembly during the transforming step (iii) is/are less than or equal to 250° C., or still preferably less than or equal to 200° C., preferably less than or equal to 180° C.

The yarn(s), in particular non-fusible, may include one or more materials chosen, independently, from synthetic, man-made (for example lyocell or viscose), natural, mineral or inorganic materials, and a combination thereof, preferably from man-made and natural materials, particularly synthetic ones.

The synthetic material(s) may include: polyesters, particularly polyethylene terephthalate (PET) and polybutylene terephthalate (PBT); the polyamides (such as PA 6, PA 6-6, PA 12, PA 4-6); polyolefins (polypropylene, polyethylene, PEEK, PEUHMW); aramids, particularly meta-aramid or para-aramid or a mixture thereof; vinyl acetates (for example EVA), polyacrylics (for example polyacrylonitrile); elastomers; elastanes or a mixture thereof, preferably if it is polyesters and polyolefins.

The natural material(s) may include: cotton, viscose, linen, sisal, wool, jute, silk, and hemp.

The mineral or inorganic material(s) may include: carbon, mineral fibers, such as minerals, such as rockwool, glass.

Monofilament yarns may have a diameter greater than 0.01 mm and less than or equal to 5 mm, including greater than or equal to 0.1 mm and less than or equal to 2 mm.

Multi-filament yarns and/or fiber spun yarns may have a titer greater than or equal to 10 dtex and less than or equal to 1000 dtex, including greater than or equal to 30 dtex and less than or equal to 500 dtex.

Multi-filament yarns can be textured yarns, FDY (Full Drawn Yarn), DTY (Draw Textured Yarn) or else POY (Partially Oriented Yarn), or a mixture thereof.

The first and second knitted tubular part(s) may also include one or more elastic yarn(s), particularly made of elastane.

In an aspect of the disclosure, the preform comprises an inner volume and perforations opening onto its outer surface. Said inner volume and the perforations are in fluid connection. In an aspect of the disclosure, the perforations open into the inner volume of the preform.

In an aspect of the disclosure, the perforations are distributed across the entirety of the outer surface of the preform intended to come into contact with the footwear assembly.

The preform may include a sole part (intended to come into contact with the sole part of the envelope defined above), a lateral part (intended to come into contact with the lateral side of the envelope defined above), a medial part (intended to come into contact with the medial side of the envelope defined above), a front part in the extension of the medial, lateral and sole parts (intended to cover the front of the envelope defined above), and a back part in the extension of the medial, lateral and sole parts (intended to cover the hindfoot, and therefore the heel, and where applicable the ankle of the envelope defined above).

In a aspect of the disclosure, the preform includes perforations in at least one of the aforementioned parts, in particular in each of the aforementioned parts.

In an aspect of the disclosure, the perforations may include substantially circular perforations.

In an aspect of the disclosure, the perforations may include (or are composed of) perforations, the largest dimension of which is contained in a circle the diameter of which is greater than 1 mm, and may include greater than or equal to 3 mm, greater than or equal to 6 mm, less than or equal to 20 mm, and less than or equal to 10 mm.

In an example, the ratio of the total sum ($cm^2$) of the surface areas of the perforations ($cm^2$) to the total surface area ($cm^2$) of the outer surface ($cm^2$) of the preform is less than or equal to 60%, including less than or equal to 40%, including less than or equal to 25%, and greater than or equal to 10%.

This is because the heat flows through the footwear assembly, but also through the perforations of the preform toward its inner volume, and conversely from its inner volume, through the perforations toward the footwear assembly.

This disposition makes it possible to further improve the esthetic and mechanical qualities of the upper by the even distribution of heat, and where applicable of a flow of gas, particularly water vapor, combined, over the footwear assembly.

In an example, a flow of gas, in particular water vapor, is sent over the footwear assembly during step (iv) of transforming, particularly through the perforations of the preform. This disposition makes it possible to make the obtained upper more flexible.

The obtained upper has an even more regular shape, and therefore a better appearance, and its mechanical properties are improved (for example better reproducibility of the tear resistance, the break strain, better resistance to fleecing). The upper obtained also has an improved feel, in particular a more flexible feel. Finally, the securing, as described above by the melting of fusible portions, is further reinforced.

A non-exhaustive explanation of these technical effects, not limiting of this disclosure, would be that the water vapor would act as a plasticizing agent on the textile and/or polymer elements that the footwear assembly includes, in particular the first and/or second knitted tubular parts.

In an example, the outer surface of the preform includes at least one metal.

In an example, the outer surface of the preform includes at least one metallic alloy, in particular a ferrous or non-ferrous alloy.

The two preceding dispositions make it possible to considerably reduce the duration of step (iii) since said at least one metal or metallic alloy(s), has or have a better thermal conductivity than the plastic or composite preforms of the prior art.

The term "metal" should here be understood to mean any metal considered as belonging to the family of metals listed in Mendeleyev's periodic classification of elements.

By way of example, a reduction by a factor of two of the thermoforming time has been observed with the use of the preform according to the disclosure, going from 80 seconds to less than 40 seconds.

In particular, the entirety of the outer surface of the perform may include at least one metal or one metallic alloy.

In an example, the preform, in its entirety, is made of at least one metal or one metallic alloy or where applicable made of a vitroceramic material.

Said at least one metal or metallic alloy may be chosen from: aluminum, iron, stainless steel, or a combination thereof.

In an example, the outer surface of the preform includes a vitroceramic material, in particular the outer surface of the preform is composed of a vitroceramic material.

In an example, the preform, in particular its outer surface, undergoes a physical and/or chemical surface treatment.

This disposition makes it possible to confer on the preform one or more additional thermal and/or mechanical properties, particularly to improve properties of resistance to corrosion, wear or shock, optimizing the use of the preform.

In an example, the sole part of the first tubular part comprises a back edge and a front edge, and the flattening opening extends longitudinally between the back edge and the front edge.

In an example, the first knitted tubular part is disposed, at least partly, substantially flat, during step (iii), on a support, such as to present an upper planar portion to be functionalized opposite a lower planar portion comprising said flattening opening.

It is thus possible to functionalize the inner face and/or the outer face of the upper planar portion by the disposition and securing of one or more functional component(s). In a variant, said at least one flattening opening is closed before the step (iv) of transforming into an upper, particularly by sewing.

In an aspect of the disclosure, the lateral edge and the medial edge of the flattening opening, i.e. at least one segment, are secured edge to edge.

In an example, the method comprises the providing of a second knitted tubular part, where applicable comprising at least one fusible portion, and the footwear assembly in step (iv) comprises the first and second knitted tubular parts, at least in part, superimposed, in connection with one or more functional component(s).

In an aspect of the disclosure, the sole part of the second knitted tubular part may include at least one flattening opening (similar to that fashioned in the first knitted tubular part), particularly of knitted construction forming a single part with the second knitted tubular part. This flattening opening is therefore also formed during the knitting of the second part and allows the flattening of the second part in order to functionalize it during step (iii).

Of course if it is not necessary to functionalize the second knitted tubular part, the latter does not include any flattening opening.

In an example, the transforming step (iv) allows the at least partial securing of the first and second knitted tubular parts to one another.

The first and second knitted tubular parts are secured following the melting of one or more fusible portions, that at least one of the first and second knitted tubular parts include.

In an aspect of the disclosure, at least a portion of the outer face of the second knitted tubular part is secured to at least a portion of the inner face of the first knitted tubular part, said securing portions comprise yarns which are at least partly heat-melted. In this case, the first knitted tubular part forms an outer layer of the footwear assembly. The converse arrangement is also possible, the second knitted tubular part forms an outer layer of the footwear assembly.

In an example, a functional component, chosen from the functional component(s), is disposed on at least one face chosen from: the outer face of the first knitted tubular part, the inner face of the first knitted tubular part, or a combination thereof.

In an example, a functional component, chosen from the functional component(s), is disposed on at least one face chosen from: the outer face of the second knitted tubular part, the inner face of the second knitted tubular part, or a combination thereof.

In an example, a functional component, chosen from the functional component(s), is a film including at least one fusible material.

In an example, after step (iv), said film forms a coating (or has dimensions determined such as to form a coating) covering at least 10%, including at least 25%, including at least 40%, including at least 50%, including at least 70%, including at least 80%, or 98% to the nearest +/−2%, of the outer surface of the upper (or of the first or second knitted tubular part), particularly with the exception of the outer surface of the sole part of the upper (or else the first or second knitted tubular part).

In an example, said film forms a coating covering at the most 50%, including at least 30%, of the outer surface of the upper (or of the first or second knitted tubular part), particularly with the exception of the outer surface of the sole part of the upper (or else of the first or second knitted tubular part).

The coating can be either continuous or discontinuous, and/or in the form of a pattern or patterns (identical or different) and/or a knit or knits, but overall covering the % of the outer surface mentioned above).

Specifically, since the upper planar portion is not totally accessible, it is not possible to dispose a film covering a significant surface area of the outer surface of the upper.

In an example, at least one of the functional component(s) is chosen from: a polymer film, at least partly fusible, a heel reinforcement element, a logo, an esthetic element, a hard cap, a reinforcement element of a lacing area, a shock-absorbing element, an auxiliary knitted tubular part, a textile element, or a combination thereof.

In an aspect of the disclosure, at least one of the functional component(s) is a shock-absorbing element, particularly a foam.

In an aspect of the disclosure, at least one of the functional component(s) is chosen from: a polymer film, at least partly fusible, a heel reinforcement element, a logo, an esthetic element, a hard cap, a reinforcement element of a lacing area, or a combination thereof.

The textile element may include one or more woven, knitted, non-woven elements or a combination thereof.

The auxiliary knitted tubular part may be identical to or different from the first knitted tubular part. The description relating to the first or second tubular part applies to the auxiliary tubular part.

In an example, the method may include the providing of a knitted tubular component, and the first knitted tubular part and the second knitted tubular part are of knitted construction forming a single part with the knitted tubular component such as to form an element made of a knitted piece.

In an example, the method may include the disposition of at least one functional component between the first knitted tubular part and the second knitted tubular part, particularly in step (iii) and/or in step (iv).

In a example, the first knitted tubular part forms an outer layer of the upper and the second knitted tubular part forms an inner layer of the upper.

The converse is also possible. The first knitted tubular part forms an inner layer of the upper, and the second knitted tubular part forms an outer layer of the upper.

In an example, the first knitted tubular part may include one or more at least partly fusible yarns, the ratio of the weight of the at least partly fusible yarn(s), to the total weight of the first knitted tubular part, is greater than or equal to 20%, including greater than or equal to 40%, including greater than or equal to 60%, including greater than or equal to 80%.

In an example, the second knitted tubular part may include one or more at least partly fusible yarn, the ratio of the weight of the at least partly fusible yarn(s), to the total weight of the second knitted tubular part, is less than or equal to 80%, including less than or equal to 60%, including less than or equal to 40%, including less than or equal to 20%.

In an example, the first knitted tubular part may include an opening area for insertion of the foot and the second knitted tubular part including an opening area for insertion of the foot. Said foot insertion opening areas are superimposed.

In an example, the at least partly fusible yarn or yarns forms or form said at least one fusible portion, such as having a melting or softening temperature less than or equal to T1, which may be less than or equal to the heating temperature(s).

In an example, the step (iv) comprises the heating of the preform to a heating temperature greater than or equal to Tp, with Tp≥T1.

In an example, the step (iv) comprises the heating of the molding volume to a heating temperature greater than or equal to Tvm, with Tvm≥T1.

The temperatures Tp and Tvm may be identical or different.

In an example, the upper obtained in step (iv) may include a sole part, and the method may include the securing of at least one sole element chosen from a midsole and an outsole to said sole part.

BRIEF DESCRIPTION OF THE DRAWINGS

The disclosure will be better understood on reading the following description of an aspect of the disclosure given by way of non-limiting example, with reference to the appended drawings, wherein:

FIG. 1 illustrates a first knitted tubular component including first and second knitted tubular parts;

FIG. 2 illustrates the first knitted tubular part of the component shown in FIG. 1, in bottom view;

FIG. 3 shows a second example of a knitted tubular component;

FIG. 4 shows the first knitted tubular part of the component shown in FIG. 1 partially flattened on a support, in top view;

FIG. 5 illustrates the first knitted tubular part of the component shown in FIG. 1 partially flattened on a support, in bottom view; and FIG. 6 illustrates the closed longitudinal flattening opening of the sole part of the first knitted tubular part of the component of FIG. 1;

FIG. 7 illustrates an example of a footwear assembly disposed on the outer surface of a preform, in longitudinal section view;

FIG. 8 illustrates the footwear assembly disposed on the outer surface of a preform placed in a molding volume for step (iv);

FIG. 9 illustrates an example of a footwear article according to the disclosure including an upper obtained at the end of the transforming step (iv).

DETAILED DESCRIPTION

FIG. 1 shows a first example of a knitted tubular component 10 made as a single piece 15, including a first knitted tubular part 20 and a second knitted tubular part 30, each one of which is elbow-bent. The knitted tubular component 10 thus has a substantial U-shape. The first and second knitted tubular parts 20, 30 are of unitary knitted construction with the knitted tubular component 10. The first knitted tubular part 20 may include an open distal end 22, which may be closed by sewing before disposition on the preform 50, an open proximal end 24 delimiting an area of insertion of the foot 26, as well as a volume 28 for housing the foot. The second knitted tubular part 30 may include a distal end 32 closed during the knitting of the tubular component 10, and an open proximal end 34 delimiting an area of insertion of the foot 36 as well as a volume 38 for housing the foot. In an example, the first and second knitted tubular parts 20, 30 may include respective heel areas 25, 35 intended to receive the heel of the foot of the user. During the programming of the knitting machine to knit the knitted tubular component 10, the zoning of the first and second knitted tubular parts 20, 20 is determined according to different knit schemes (reverse jersey, straight jersey, ribbing etc.) and different types of yarn (differing by their nature and/or their color and/or their transparency and/or their titer (dtex)). It is thus possible to vary the relief, thickness, appearance, and functionality of the determined area or areas, and this for the first knitted tubular part 20 and the second knitted tubular part 30, independently of one another.

Alternatively, a single one of the first and second tubular parts 20 and 30 may include an elbow-bent portion such that the tubular component 10 has a general L-shape.

The first knitted tubular part 20 may include at least partly fusible yarns disposed in one or more portions. The second knitted tubular part 30 may also include one or more fusible portions formed of at least partly fusible yarns. The at least partly fusible yarns for example account for at least 30% in weight, and at the most 60% in weight, of the total weight of the first knitted tubular part, and are distributed over the entirety of the latter. Alternatively, the first knitted envelope 20 may be essentially composed of fusible yarns.

The at least partly fusible yarns account, for example, for at least 50% in weight, and at the most 80% in weight, of the total weight of the second knitted tubular part, and are distributed over the entirety of the latter. This disposition can of course vary according to the stability and flexibility desired.

FIG. 2 shows the first knitted tubular part 20 in bottom view, the sole part 27 of which may include a longitudinal flattening opening 29 disposed between the front 27*a* and back 27*b* edges. The longitudinal opening 29 is a through opening, i.e. it opens both on the outer face 21 and the inner face 23 of the first knitted tubular part 20. The opening 29 is formed of a single substantially straight segment. The longitudinal opening 29 is delimited by a medial edge 29*a* and a lateral edge 29*b*, and has a length l1 between 50% and 90% of the length p of the sole part 27, including between 60% and 80% of the length p.

FIG. 3 shows a second example of a knitted tubular component 100 also made as a single piece 150, including first and second knitted tubular parts 200 and 300. The knitted tubular component 100 is substantially straight, the first and second tubular portions 200 and 300 not including any elbow portions. The sole part 270 may include a longitudinal opening 290 similar to the longitudinal opening 29.

The longitudinal opening 29 of the knitted tubular component 10 makes it possible to flatten the first tubular part 20 on a support S as shown in FIG. 4 in top view for its functionalizing, here of the outer face 21 of the forefoot, medial and lateral parts of the first knitted tubular part 20. FIG. 4 thus shows an upper planar portion 42 of the first knitted tubular part 20, opposite a planar lower portion 44 shown in FIG. 5. The open distal end 22 can be closed before or after the functionalizing step (iii) to form the tip of the foot receiving the toes of the first knitted tubular part 20. Advantageously, the flattening longitudinal opening 29 is formed during the knitting of the first knitted tubular part 20, and therefore of the knitting of the knitted tubular component 10. The medial and lateral edges 29*a* and 29*b* may not include any cut threads. They can for example be formed by stitch transfer, such that they do not risk unraveling. This is because the unraveling of the edges could alter the structure of the sole part 27 and propagate to the other parts of the first knitted tubular part 20. The longitudinal opening 29 formed by knitting makes it possible to dispense with a cutting-out step, to form an opening, the position and size of which are reproducible but also to improve the stability of the structure during the functionalizing when flat.

Four functional components 75 are secured to the outer face 21, for example by a seam, or a weld (particularly heat welding, for example ultrasonic) or using an adhesive agent. The functional components 75 are cited by way of non-limiting example for illustrative purposes; other functional components could be implemented, and according to different regions on the outer face 21 and/or the inner face 23 of the first knitted tubular part 20. The size and location retained for the functional components are however limited to the available planar surface shown in FIG. 4. The second knitted tubular part 30 is not shown for simplicity's sake in FIGS. 4 and 5. Here the outer face 21 is available to be functionalized but the first knitted tubular part 20 could be turned over and flattened to functionalize its inner face 23. As can be seen in FIG. 7, the footwear assembly 40 also may include a functional component 60 which is a heel reinforcement and a functional component 70 which is a shock-absorbing instep. The functional components 60 and 70 are disposed between the first and second knitted tubular parts 20 and 30, respectively between the instep parts and the hindfoot parts at the level of the heel. The functional component 60 extends vertically to the longitudinal axis L. These components 70 and 60 are not shown in FIGS. 4 and 5 for simplicity's sake, but may be secured to the inner face 23 of the upper planar portion 42 of the first knitted tubular part 20.

The longitudinal opening 29 is then closed, particularly using a seam 35 in order to restore volume to the footwear assembly 40, then the footwear assembly 40 is placed on a preform 50 as shown in FIG. 7 to undergo a transforming step (iv) during which the preform 50 covered in the footwear assembly 40 is placed in a molding volume 80. The molding volume 80 is delimited between, on the one hand, the preform 50 covered in the footwear assembly 40 and on the other hand, the volume formed by a mold 90 made of two parts 95 and 96. The inner volume of the mold 90 substantially corresponding to the footprint of the foot-shaped preform 50. Alternatively, the molding volume can also be delimited between the outer surface of the preform 50 and a flexible airtight membrane, comprising a hollow form substantially in the foot shape to fit the footwear assembly disposed on the preform 50.

Heat, particularly combined with water vapor, is then applied to the footwear assembly 40 in order to thermoform the footwear assembly 40 to the foot shape of the preform 50. The fusible portion(s) may include the first knitted tubular part 20 and eventually include the second knitted tubular part 30, is/are melted/softened during the transforming step (iv). The footwear assembly 40 is also compressed against the outer surface of the preform 50. The footwear assembly 40, still on the preform 50, is then cooled, particularly at ambient temperature, and then keeps the shape of the outer surface of the preform 50. This transforming step (iv) further allows the thermoforming to secure to one another the first and second knitted tubular parts 20 and 30 particularly at least partially according to their respective inner 23 and outer 31 faces.

The knitted tubular component 10 may alternatively include solely the first knitted tubular part 20. In this case, the transforming step allows only the thermoforming of the first knitted tubular part without securing.

Alternatively again, the first knitted tubular part 20 can be disposed in the inner volume 38 of the second knitted tubular part 30. The second knitted tubular part then forms the outer layer of the footwear assembly and the first knitted tubular part forms the inner layer.

The preform may also include perforations, in particular having a diameter of 5 mm to 10 mm approximately, opening onto an inner volume of the preform such that the perforations and the inner volume of the preform are in fluid connection. The perforations make it possible to inject water vapor over the footwear assembly starting from the inner volume. This disposition makes the obtained upper more flexible.

The transforming step (iv) allows the formation of an upper 400, the sole part 450 of which is then secured to a sole element 500 for the obtaining of the footwear article 1 shown in FIG. 9. The upper 400 may thus include different knitted areas 401 to 406 for the first knitted tubular part 20. The areas 401 to 406 differ by their knit schemes, their colors, their elasticity or their stiffness. The areas 406 thus correspond to knitted unidirectional reinforcement elements reinforcing the medial and lateral parts of the upper 400.

The flattening opening shown in the figures is a longitudinal opening. Of course, the opening can have the shape of a cross or another shape as long as the shape of this opening allows the flattening of the knitted tubular part include therein.

The invention claimed is:

1. A method for manufacturing a footwear article comprising:

providing a first knitted tubular part comprising at least one fusible portion, at least one sole part, at least one flattening opening of unitary knitted construction with the first knitted tubular part and extending at least in the sole part, and one or more functional components;

disposing, at least partly, the first knitted tubular part substantially flattened using the flattening opening, the first knitted tubular part being disposed flattened during functionalizing, on a support, such as to present an upper planar portion to be functionalized opposite to a lower planar portion comprising, at least in part, said at least one flattening opening, said upper planar portion being disposed in a plane in two dimensions;

functionalizing the first knitted tubular part, at least partly, substantially flattened, with one or more functional components to form a footwear assembly; and then transforming the footwear assembly on a preform having a foot shape in an upper, wherein transforming the footwear assembly comprises thermoforming the footwear assembly to follow the foot shape of the preform.

2. The method of claim 1, wherein the sole part of the first knitted tubular part comprises a rear edge and a front edge, and the flattening opening extends between the rear edge and the front edge.

3. The method of claim 1, wherein the flattening opening is closed before transforming the footwear assembly.

4. The method of claim 1, further comprising providing a second knitted tubular part, wherein the footwear assembly that is transformed comprises the first and second knitted tubular parts, at least in part, superimposed, linked to one or more functional components.

5. The method of claim 4, wherein transforming the footwear assembly further comprises the at least partial securing of the first and second knitted tubular parts to one another.

6. The method of claim 4, further comprising the layout of at least one functional component between the first knitted tubular part and the second knitted tubular part.

7. The method of claim 4, wherein the first knitted tubular part forms an outer layer of the upper and the second knitted tubular part forms an inner layer of the upper.

8. The method of claim 4, further comprising providing a knitted tubular component, wherein the first knitted tubular part and the second knitted tubular part are of unitary knitted construction with the knitted tubular component such as to form an element made of a knitted piece.

9. The method of claim 4, wherein the first knitted tubular part comprises an opening area for insertion of the foot and the second knitted tubular part comprises an opening area for insertion of the foot, wherein the foot insertion opening areas are superimposed.

10. The method of claim 4, wherein the second knitted tubular part comprises one or more fusible yarns, wherein the ratio of the weight of the at least partly fusible yarns to the total weight of the second knitted tubular part is less than or equal to 80%.

11. The method of claim 1, wherein the at least one functional components are selected from a group of at least one of: a polymer film, at least partly fusible, a heel reinforcement element, a logo, an esthetic element, a hard cap, a textile element, a reinforcement element of a lacing area, a shock-absorbing element, an auxiliary knitted tubular part, or a combination thereof.

12. The method of claim 1, wherein the first knitted tubular part comprises one or more at least partly fusible yarns, wherein the ratio of the weight of the at least partly fusible yarns to the total weight of the first knitted tubular part is greater than or equal to 20%.

13. The method of claim 1, wherein the one or more functional components is disposed on at least one face selected from a group of: the outer face of the first knitted tubular part, the inner face of the first knitted tubular part, or a combination thereof.

14. The method of claim 1, wherein the one or more functional components is a film comprising at least one fusible material.

15. The method of claim 14, wherein after functionalizing, the film forms a coating covering at least 10% of an outer surface of the upper.

16. The method of claim 1, wherein the upper comprises a sole part, and further comprising securing at least one sole element chosen from a midsole and an outsole to the sole part.

17. An article of footwear prepared in accordance with the method of:

providing a first knitted tubular part comprising at least one fusible portion, at least one sole part, at least one flattening opening of unitary knitted construction with the first knitted tubular part and extending at least in the sole part, and one or more functional components;

disposing, at least partly, the first knitted tubular part substantially flattened using the flattening opening, the first knitted tubular part being disposed flattened during functionalizing, on a support, such as to present an upper planar portion to be functionalized opposite to a lower planar portion comprising, at least in part, at least one flattening opening, said upper planar portion being disposed in a plane in two dimensions;

functionalizing the first knitted tubular part, at least partly, substantially flat, with one or more functional components to form a footwear assembly;

transforming the footwear assembly on a preform having a foot shape in an upper, wherein transforming the footwear assembly comprises thermoforming the footwear assembly to follow the foot shape of the preform.

* * * * *